US007234777B2

(12) United States Patent
Schweikarth et al.

(10) Patent No.: US 7,234,777 B2
(45) Date of Patent: Jun. 26, 2007

(54) CHAIR WITH ADJUSTABLE ARMRESTS AND BACKREST

(75) Inventors: Derek R Schweikarth, Jasper, IN (US); Chad M Kieffner, Jasper, IN (US)

(73) Assignee: Kimball International, Inc., Jasper, IN (US)

( * ) Notice: Subject to any disclaimer, the term of this patent is extended or adjusted under 35 U.S.C. 154(b) by 86 days.

(21) Appl. No.: 10/801,467

(22) Filed: Mar. 16, 2004

(65) Prior Publication Data

US 2005/0206209 A1 Sep. 22, 2005

(51) Int. Cl.
*B60N 2/02* (2006.01)
*B60N 2/46* (2006.01)

(52) U.S. Cl. ..... 297/353; 297/411.25; 297/411.36

(58) Field of Classification Search ..... 297/411.36, 297/411.31, 411.25, 411.24, 411.26, 411.44, 297/411.45, 353, 354.12, 411.35, 410, 383
See application file for complete search history.

(56) References Cited

U.S. PATENT DOCUMENTS

| | | | | | |
|---|---|---|---|---|---|
| 518,097 | A | | 4/1894 | Derby | |
| 735,313 | A | | 8/1903 | Stubbs | |
| 766,484 | A | | 8/1904 | Armstrong | |
| 1,826,643 | A | * | 10/1931 | Anderson | 297/296 |
| 2,030,635 | A | | 2/1936 | Horwitt et al. | |
| 2,091,733 | A | * | 8/1937 | Hemminger et al. | 297/353 |
| 2,599,301 | A | | 6/1952 | Van Buren | |
| 2,602,488 | A | * | 7/1952 | Conning | 297/411.25 |
| 2,602,489 | A | | 7/1952 | Holten | 155/161 |
| 2,637,371 | A | | 5/1953 | Boutin | |
| 2,725,928 | A | * | 12/1955 | Branick | 297/411.25 |
| 2,942,651 | A | | 6/1960 | Binding | |
| 2,988,398 | A | | 6/1961 | Hamilton | |
| 4,828,320 | A | | 5/1989 | Saiger | 297/229 |
| D327,782 | S | | 7/1992 | Citterio | D6/366 |
| 5,374,102 | A | | 12/1994 | Archambault et al. | 297/344.13 |
| 5,547,253 | A | | 8/1996 | Schwartz et al. | 297/338 |
| 5,664,835 | A | | 9/1997 | Desanta | 297/302.1 |
| 5,667,274 | A | | 9/1997 | Blackman | 297/338 |
| D400,018 | S | | 10/1998 | James et al. | D6/366 |

(Continued)

FOREIGN PATENT DOCUMENTS

| | | |
|---|---|---|
| EP | 0 049 700 | 4/1982 |

(Continued)

*Primary Examiner*—Anthony D. Barfield
(74) *Attorney, Agent, or Firm*—Baker & Daniels LLP

(57) ABSTRACT

A task chair is disclosed, including a base, a seat supported by the base, and a pair of uprights connected to the base and extending upwardly from the seat. A pair of armrests are attached respectively to the uprights, and are selectively positionable along the uprights in a manner in which the height of the armrests along the uprights is adjustable. A backrest is also selectively positionable along the uprights, and the height of the backrest with respect to the seat may be adjusted by moving the backrest upwardly or downwardly along the uprights. The armrests and backrest each include mount sleeves telescopingly slidable along the uprights, each of the mount sleeves including a user-operable adjustment mechanism which includes a lever having a portion thereof selectively engagable with one of a series of holes along the uprights. The adjustment mechanisms of the mount sleeves of the armrests and the backrest are easily operated by a user to independently adjust the armrests and the backrest vertically along the uprights.

23 Claims, 7 Drawing Sheets

U.S. PATENT DOCUMENTS

| | | | | |
|---|---|---|---|---|
| D401,453 | S | 11/1998 | Holt | D6/502 |
| D408,161 | S | 4/1999 | Caruso | D6/366 |
| 5,904,398 | A | 5/1999 | Farricielli | 297/313 |
| D411,928 | S | 7/1999 | Ritch et al. | D6/500 |
| 6,099,076 | A | 8/2000 | Nagel et al. | 297/337 |
| 6,158,810 | A | 12/2000 | Galloway | 297/354.1 |
| D446,954 | S | 8/2001 | Sottsass | D6/366 |
| D449,172 | S | 10/2001 | Van De Riet et al. | D6/366 |
| D449,938 | S | 11/2001 | Van De Riet et al. | D6/380 |
| D451,693 | S | 12/2001 | Pearce et al. | D6/368 |
| 6,352,307 | B1 | 3/2002 | Engman | 297/284.11 |
| D455,571 | S | 4/2002 | Van De Riet et al. | D6/374 |
| D456,160 | S | 4/2002 | Van De Riet et al. | D6/366 |
| D456,164 | S | 4/2002 | Van De Riet et al. | D6/374 |
| D456,627 | S | 5/2002 | Pearce et al. | D6/366 |
| D457,007 | S | 5/2002 | Pearce et al. | D6/368 |
| D457,739 | S | 5/2002 | Pearce et al. | D6/366 |
| 6,386,636 | B2 | 5/2002 | Caruso et al. | 297/353 |
| D460,870 | S | 7/2002 | Van De Riet et al. | D6/366 |
| D461,327 | S | 8/2002 | Pearce et al. | D6/368 |
| D463,174 | S | 9/2002 | Chu | D6/500 |
| D463,920 | S | 10/2002 | Pearce et al. | D6/366 |
| D465,938 | S | 11/2002 | Huang | D6/366 |
| D479,416 | S | 9/2003 | Raftery | D6/502 |
| 6,623,078 | B2 * | 9/2003 | Chu et al. | 297/411.36 |
| D484,710 | S | 1/2004 | Getzel | D6/366 |
| D485,097 | S | 1/2004 | Raftery | D6/502 |
| D486,315 | S | 2/2004 | Beaulieu et al. | D6/366 |
| D487,197 | S | 3/2004 | Edwards et al. | D6/366 |
| D487,641 | S | 3/2004 | James | D6/366 |
| 6,705,678 | B1 | 3/2004 | Albright et al. | 297/353 |
| D490,621 | S | 6/2004 | Newhouse | D6/366 |
| D493,626 | S | 8/2004 | James | D6/366 |
| 6,811,224 | B2 | 11/2004 | Roney et al. | 297/411.35 |
| 2002/0158500 | A1 | 10/2002 | Chu et al. | 297/411.36 |
| 2003/0193229 | A1 | 10/2003 | VanDeRiet et al. | 297/411.23 |
| 2004/0189073 | A1 * | 9/2004 | Chadwick et al. | 297/383 X |

FOREIGN PATENT DOCUMENTS

| | | |
|---|---|---|
| GB | 2 041 439 | 9/1980 |

* cited by examiner

CHAIR WITH ADJUSTABLE ARMRESTS AND BACKREST

BACKGROUND OF THE INVENTION

1. Field of the Invention

The present invention relates to chairs, such as task chairs of the type which are used in an office or other workplace setting. In particular, the present invention relates to a task chair having adjustable armrests and an adjustable backrest.

2. Description of the Related Art

Task chairs are used for seating users while working in an office or another workplace environment, and include a seat, a backrest, and optionally, a pair of armrests. A base assembly supports the seat, backrest, and armrests, and usually includes one or more adjustment features for adjusting the movement characteristics of the chair, such as seat height, seat depth, seat tilt, or resistance to reclining of the backrest, for example. The armrests may also include adjustment features for adjusting the movement characteristics of the armrests, such as the height of the armrests, and pivotal or lateral movement of the armrests, for example. The base assembly of the chair may include one or more rigid chair legs, such as in a side chair, or alternatively, may include a "spider"-type base assembly including radial arms with casters for rolling movement of the chair along a floor surface.

Problematically, the operation of the manual adjustment features of many known task chairs is often not intuitive to the user, and may require a type of learning process on the part of the user, in which the user first locates the various adjustment controls on the chair, and then figures out how to manipulate the controls to adjust the movement characteristics of the chair. Also, the adjustment controls in many known task chairs are mechanically complex and expensive to manufacture.

Additionally, the backrests of many task chairs are not vertically adjustable, but rather are located in a fixed vertical position relative to the seat. Thus, in many known task chairs, the backrest is not adjustable for users of different height.

What is needed is a task chair which is an improvement over the foregoing.

SUMMARY OF THE INVENTION

The present invention provides a task chair including a base, a seat supported by the base, and a pair of uprights connected to the base and extending upwardly from the seat. A pair of armrests are attached respectively to the uprights, and are selectively positionable along the uprights in a manner in which the height of the armrests along the uprights is adjustable. A backrest is also selectively positionable along the uprights, and the height of the backrest with respect to the seat may be adjusted by moving the backrest upwardly or downwardly along the uprights. The armrests and backrest each include mount sleeves telescopingly slidable along the uprights, each of the mount sleeves including a user-operable adjustment mechanism which includes a lever having a portion thereof selectively engagable with one of a series of holes along the uprights. The adjustment mechanisms of the mount sleeves of the armrests and the backrest are easily operated by a user to independently adjust the armrests and the backrest vertically along the uprights.

The base of the chair may include a "spider"-type leg assembly, including a plurality of legs including casters for rolling movement of the chair along a floor surface. Alternatively, the base of the chair may include a set of fixed chair legs. A pneumatic height-adjusting cylinder connects the base assembly with a control housing of the chair, and allows vertical height adjustment of the chair with respect to the floor surface. The control housing is an existing component available from many commercial sources, and may facilitate one ore more adjustable movement characteristics of the chair, such as seat depth or tilt adjustments, or adjustment of the resistance of reclining of the seat and/or backrest.

The uprights may take the form of a U-shaped yoke member having a base portion and leg portions, with the base portion connected to the seat support structure beneath the seat. The uprights extend upwardly from opposite sides of the seat proximate the rear portion of the seat, and each include a series of holes therealong. The armrests and backrest each include mount sleeves telescopingly slidable along the uprights. Each of the mount sleeves include an adjustment mechanism for selectively positioning the armrests and the backrest in selected positions along the uprights. Advantageously, in this manner, both the armrests and the backrest are commonly attached to the uprights, which greatly simplifies the overall structure of the chair, and obviates the need for separate structures connecting the backrest and the armrests to the chair base.

The adjustment mechanisms of the mount sleeves of the armrests and the backrest each include a lever pivotally mounted within a recessed cavity in the mount sleeves, and the lever is easily visible and operable by a user. The lever is movable between a first position in which a portion of the lever engages one of the holes in the upright to fix the position of the mount sleeves of the armrests and the backrest with respect to the uprights, and a second position in which the portion of the lever is released from the hole to allow vertical, sliding adjustment of the mount sleeves of the armrests or the backrest with respect to the uprights. Thus, the vertical positions of the armrests and the backrest are easily manually adjustable by a user to conform to the posture of the user.

In one form thereof, the present invention provides a chair, including a base assembly; a seat supported by the base assembly; a pair of uprights connected to the base assembly and extending upwardly above the seat, each upright including a longitudinal axis; an armrest selectively positionable along each upright; and a backrest disposed between the uprights and selectively positionable along the uprights, one of the armrests and the backrest moveable coaxially along each of the longitudinal axes of the uprights.

In another form thereof, the present invention provides a chair, including a base assembly; a seat supported by the base assembly; a pair of uprights connected to the base assembly and extending upwardly above the seat; a pair of armrests each including a mount sleeve selectively positionable along a respective upright; and a backrest disposed between the uprights and including a pair of opposite mount sleeves selectively positionable along the uprights, the mount sleeves of the backrest disposed above the mount sleeves of the armrests.

In a further form thereof, the present invention provides a chair, including a base assembly; a seat supported by the base assembly; a pair of uprights connected to the base assembly, the uprights extending upwardly from the seat; an armrest mounted to each upright; a backrest mounted to the uprights and disposed therebetween; and means for selectively positioning the armrests and the backrest along the uprights.

BRIEF DESCRIPTION OF THE DRAWINGS

The above-mentioned and other features and advantages of this invention, and the manner of attaining them, will become more apparent and the invention itself will be better understood by reference to the following description of an embodiment of the invention taken in conjunction with the accompanying drawings, wherein.

Corresponding reference characters indicate corresponding parts throughout the several views. The exemplification set out herein illustrates one embodiment of the invention, in one form, and such exemplification is not to be construed as limiting the scope of the invention any manner.

DETAILED DESCRIPTION

Figure 1:
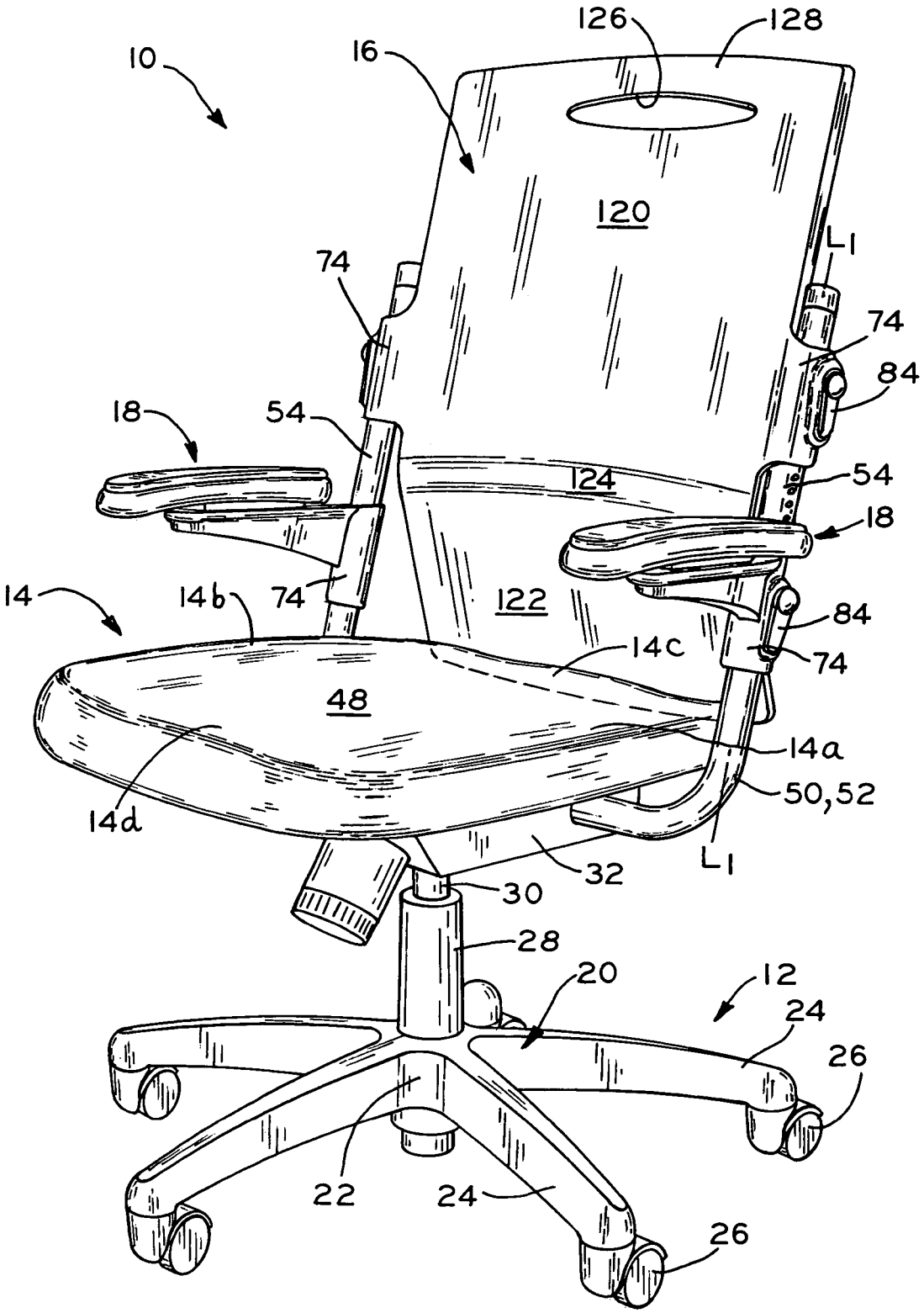
FIG. 1 is a front perspective view of a task chair of the present invention.

Referring to FIG. 1, task chair 10 is shown in accordance with the present invention. Task chair 10 generally includes base assembly 12, seat 14, backrest 16, and armrests 18, as discussed in further detail below. Base assembly 12 of chair 10 includes a "spider"-type base 20 including central hub 22 and a plurality of legs 24 extending radially therefrom. The terminal end of each leg 24 includes a caster wheel 26, allowing rolling movement of chair 10 along a floor surface. Alternatively, chair 10 may include a set of fixed, vertical chair legs. Received within central hub 22 of base 20 is a pneumatic cylinder assembly, including cylinder 28 mounted in central hub 22 and piston 30 slidably received within cylinder 28. Pneumatic cylinder assemblies for task chairs are known components which are available from many commercial sources, and generally provide vertical adjustment of the height of chair 10 with respect to base 20 and a floor surface. Piston 30 of the pneumatic cylinder assembly is connected to a control housing 32.

Figure 2:
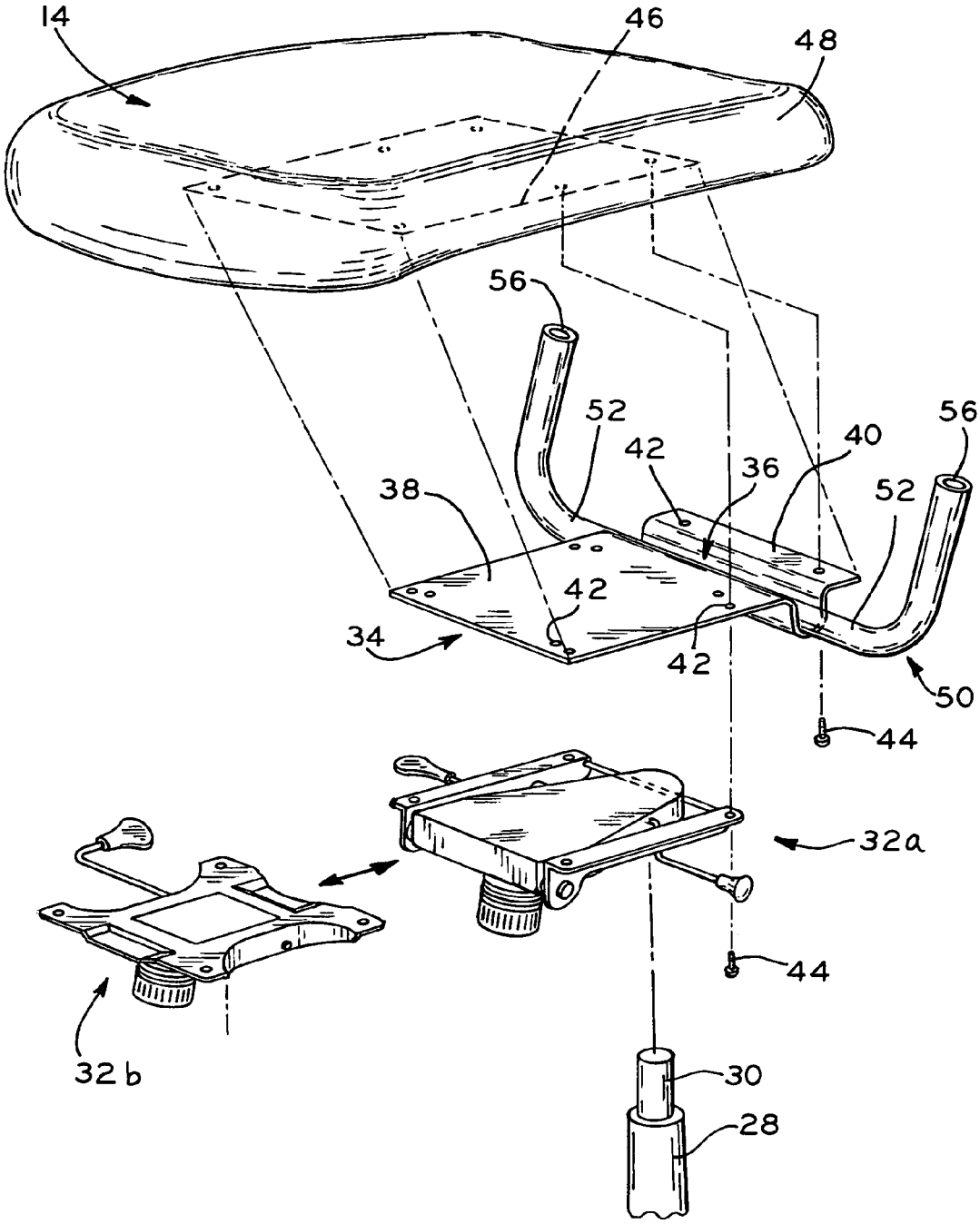
FIG. 2 is an exploded perspective view of the base assembly of the chair of FIG. 1, showing the base, support plate, yoke base, seat plate, and two different types of control housings which may be used with the chair.

Referring additionally to FIG. 2, control housing 32 is another known component which is available from many commercial sources, and generally supports seat 14 of chair 10 in the manner discussed below. Control housing 32 may facilitate one or more of the movement characteristics of chair 10, such as the depth of seat 14, the tilt of seat 14, or the reclining of seat 14 and/or backrest 16. Further, control housing 32 may include suitable structure for adjusting the foregoing movement characteristics.

In FIG. 2 for example, two different types of control housings 32*a* and 32*b* are shown which may be selectively used with chair 10. Control housing 32*a* generally includes an adjustment lever for adjusting the height of the pneumatic cylinder assembly, and may further provide both a recline tension adjustment feature and a seat tilt feature, for example. Control housing 32*b* generally includes an adjustment lever for adjusting the height of the pneumatic cylinder assembly, and may further provides a recline tension adjustment feature, for example. The particular type of control housing 32*a* or 32*b* which may used with chair 10, and the type of adjustable movement characteristics which may be provided by such control housings, may vary substantially and therefore, control housings 32*a* and 32*b* are not discussed in detail herein.

In FIG. 2, support plate 34 is shown, which may be formed from a suitable metal such as sheet metal or aluminum, for example. Support plate 34 includes channel 36 formed therein, with channel 36 disposed between front and rear portions 38 and 40 of support plate 34. Front and/or rear portions 38 and 40 of support plate 34 also include a plurality of apertures 42 for mounting a control housing 32*a* or 32*b* and seat plate 46 to support plate 34. As shown in FIG. 2, a series of fasteners 44 are inserted through apertures in a control housing 32*a* or 32*b* and through apertures 42 in support plate 34 into seat plate 46 to secure the foregoing components together, with support plate 34 captured between control housing 32 and seat plate 46. Support plate 34 may include multiple sets of apertures 42, each set configured for attachment of a different type of control housing. Thus, as indicated in FIG. 2, chair 10 may include different types of control housings 32, such as control housings 32*a* and 32*b*, for example, depending upon the particular movement characteristics which are desired for chair 10. Seat plate 46 is a flat or pan-shaped component formed of a suitable metal or rigid plastic, for example, and supports seat cushion 48, which is attached to seat plate 46 in a suitable manner.

Figure 4:
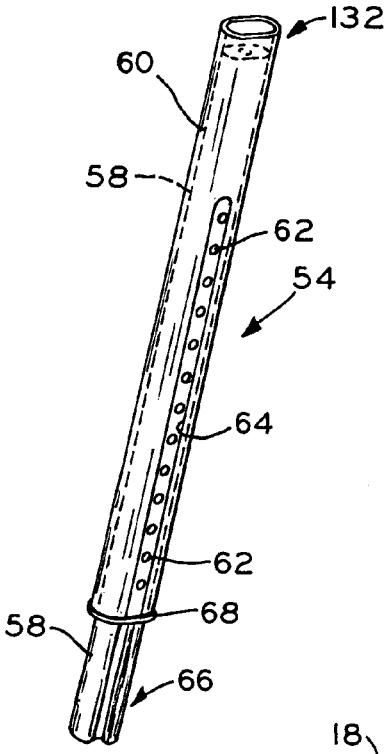
FIG. 4 is an enlarged perspective view of one of the uprights of FIG. 3.
Figure 3:
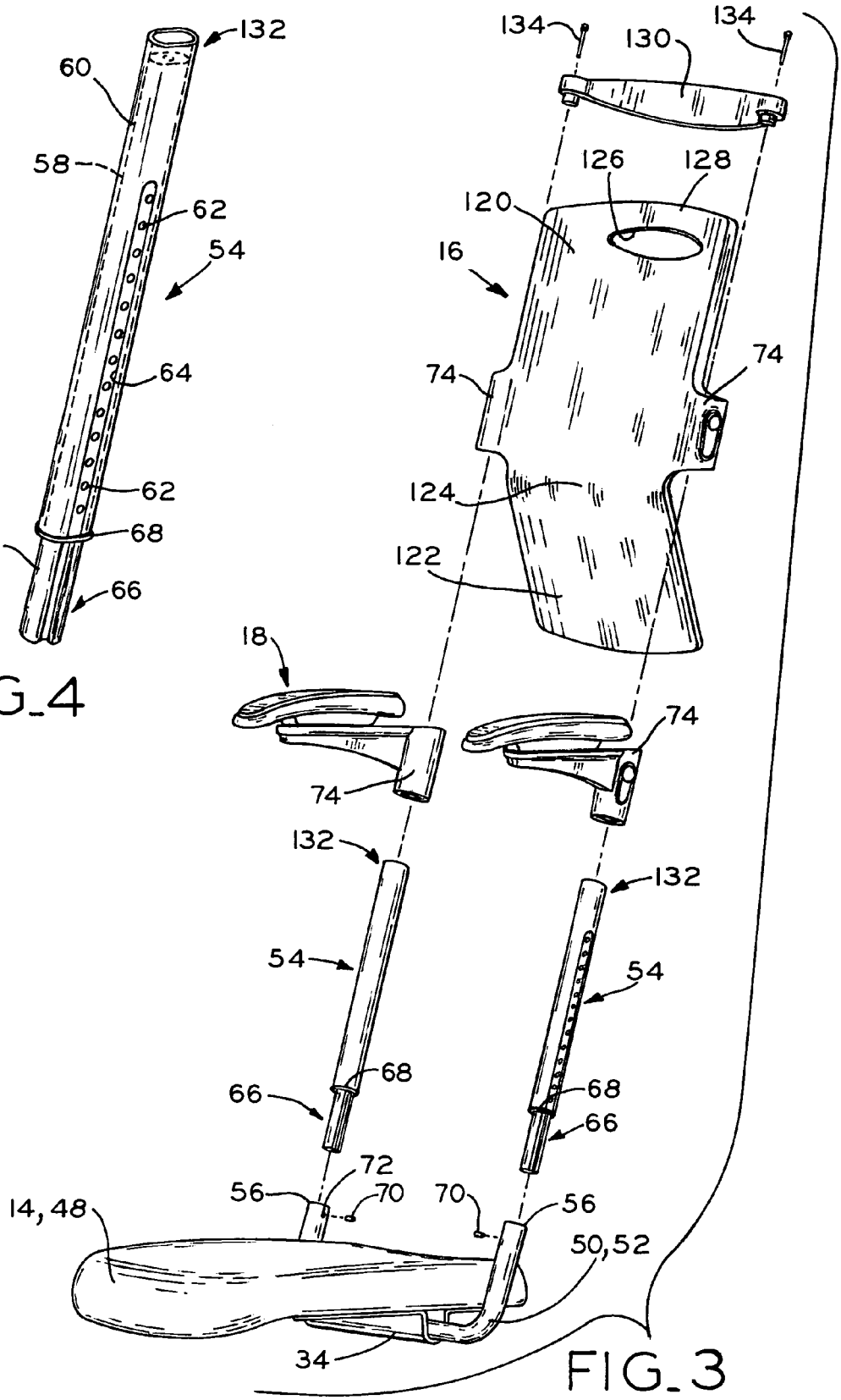
FIG. 3 is an exploded perspective view of the upper portion of the chair, showing the seat, yoke base, uprights, armrests, backrest, and support brace.

Received within channel 36 of support plate 34 is U-shaped yoke member 50, which generally includes yoke base 52 and a pair of uprights 54 (FIGS. 3 and 4). Yoke base 50 is shown herein as having a tubular profile, and may be made from suitable tubular metal stock, such as aluminum. Yoke base 52 is fixedly secured to channel 36 of support plate 34 in a suitable manner, such as by welding or by suitable fasteners (not shown). Alternatively, yoke base 52 may be mounted directly to a suitable control housing 32*a* or 32*b* in a manner in which U-shaped yoke member 50 and backrest 16 are reclinable. Yoke base 52 includes open end portions 56 into which uprights 54 are fitted, as described below.

Referring to FIGS. 3 and 4, uprights 54 each generally include a substrate tube 58, such as aluminum tubing, and a plastic outer layer 60. Tubes 58 each further include a series of holes 62 therealong. Plastic outer layer 60 is molded around tubes 58, such as by injection molding, for example, and plastic outer layer 60 includes a channel 64 with holes therealong which are in alignment with the series of holes 62 in tubes 58. The surface of plastic outer layer 60 may be smooth, or alternatively, may be textured as desired. One suitable material for plastic outer layer 60 is an acetal plastic resin material. Lower ends 66 of uprights 54 include portions of tubes 58 which are not covered by plastic outer layer 60, and lower ends 66 of uprights 54 are inserted into open end portions 56 of yoke base 52 until stops 68 projecting from plastic outer layer 60 contact open end portions 56 of yoke base 52 to serve as a stop to insertion of uprights 54 into yoke base 52. Set screws 70 are inserted through apertures 72 in end portions 56 of yoke base 52 and into engagement with lower ends 66 of uprights 54 to fixedly secure uprights 54 to yoke base 52.

Figure 8:
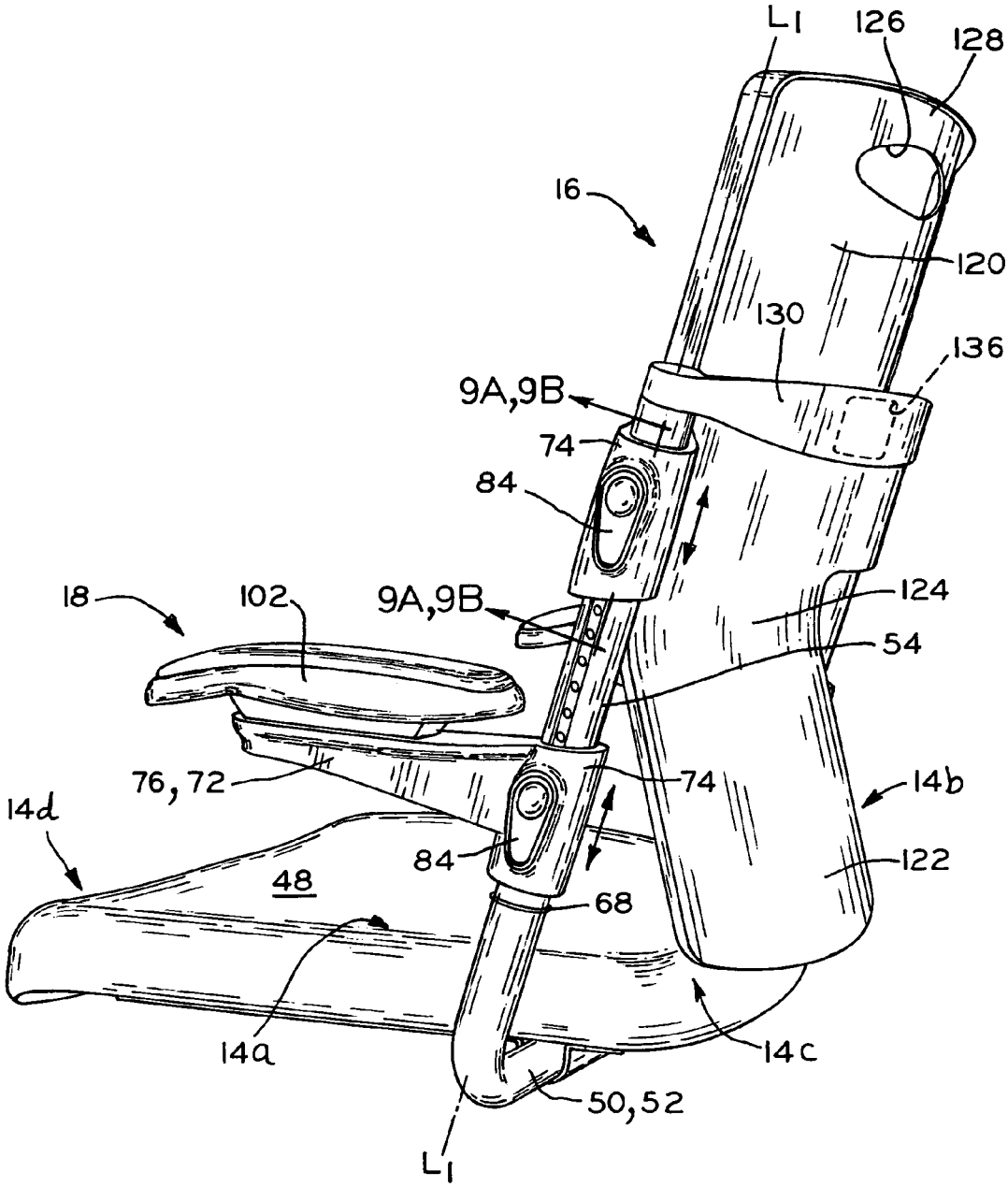
FIG. 8 is a rear perspective view of the upper portion of the chair, showing the manner in which the armrests and the backrest are moveable along the uprights.

As shown in FIGS. 1 and 8, uprights 54 extend upwardly from yoke base 52 at the opposite sides 14*a* and 14*b* of seat 14, and are disposed proximate a rear portion 14*c* of seat 14 which is spaced from front portion 14*d* of seat 14. Each upright 54 includes a longitudinal axis $L_1$—$L_1$ which extends at a slight angle from vertical. Although uprights 54 are shown herein as straight members disposed along a single longitudinal axis $L_1$—$L_1$, uprights 54 could also be curved or bent such that uprights 54 deviate from longitudinal axes $L_1$—$L_1$ along at least a portion of their length. For example, a first portion of uprights 54 may be disposed along a first longitudinal axis and include armrests 18, and a second portion of uprights 54 may be disposed along a second longitudinal axis and include backrest 16, with a bend in uprights 54 separating the first and second portions of uprights 54.

Figure 5:
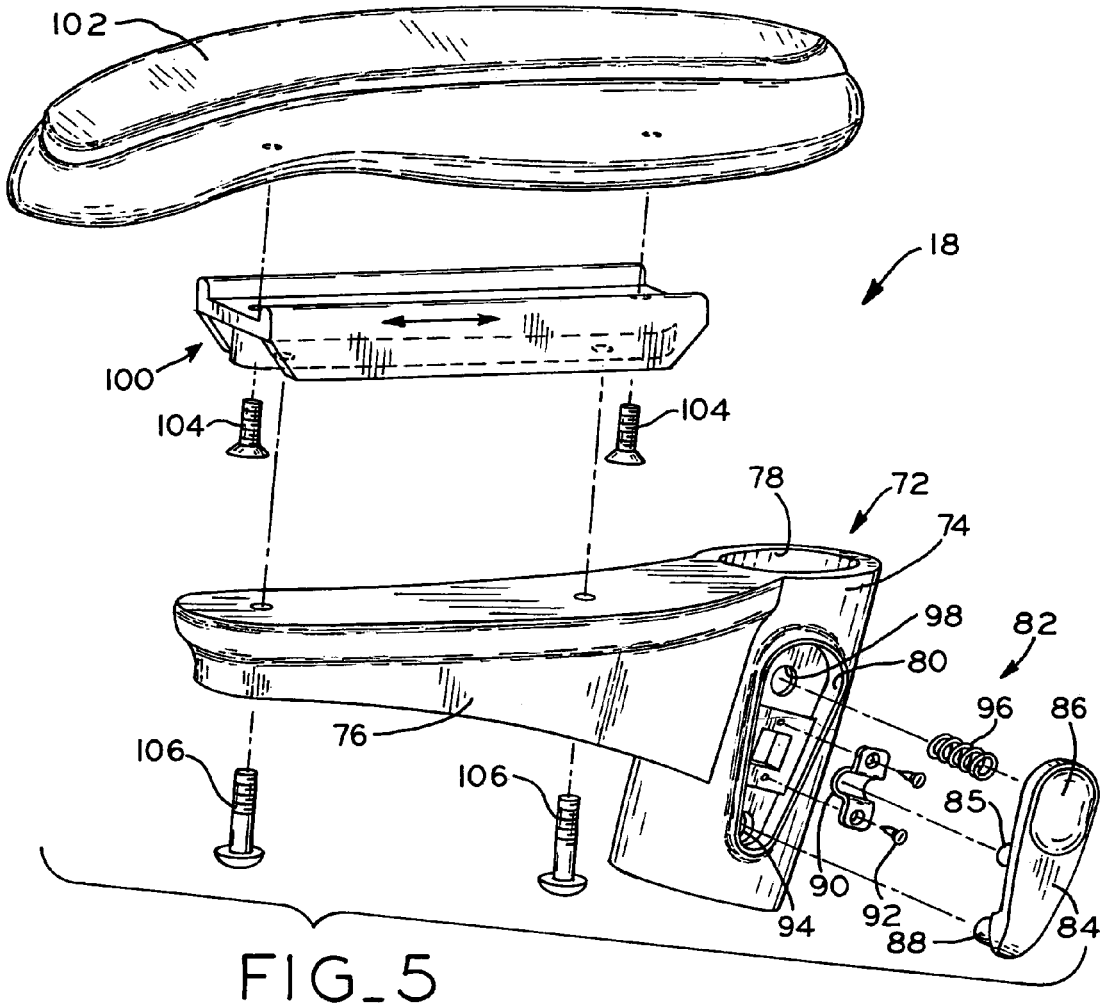
FIG. 5 is an exploded perspective view of one of the armrests, showing the components of the adjustment mechanism within the mount sleeve of the armrest, and further showing the components of the slide mechanism of the armrest.
Figure 6:
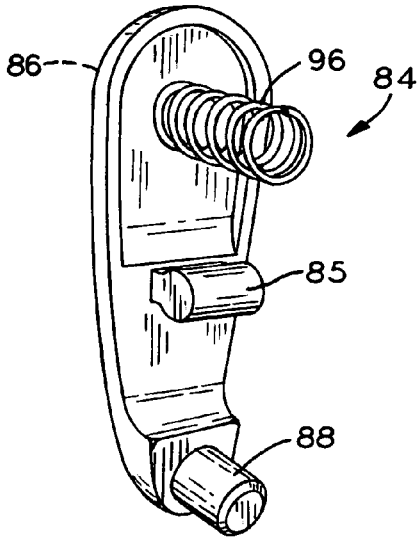
FIG. 6 is a rear perspective view of the lever of the adjustment mechanism of FIG. 5.

Referring to FIG. 5, armrests 18 are shown. Each armrest 18 includes an armrest base 72 including a mount sleeve 74 and an armrest support 76, which may be formed together as an integral plastic component, for example. Mount sleeve 74 has a generally cylindrical profile, and includes an opening or passage 78 therethrough. Uprights 54 and openings 78 of mount sleeves 74 may have complementary oval-shaped cross-sections to prevent relative rotation between uprights 54 and mount sleeves 74. Mount sleeve 74 additionally includes a recessed cavity 80 in a side thereof which faces outwardly of uprights 54 and chair 10 for easy access by a user, with cavity 80 housing adjustment mechanism 82. Adjustment mechanism 82 includes lever 84, also shown in FIG. 6, having a button 86 at a first end thereof, and a pin 88 at its opposite second end. As may be seen from FIGS. 1 and 8, lever 84 is easily visible by a user, and is easily operated in the manner described below. Pivot bracket 90 is attached within cavity 80 by a pair of fasteners 92, and lever 84 is mounted to pivot bracket 90 for pivotal movement by inserting pivot portion 85 of lever 84 into pivot bracket 90 in a snap-fit manner. Pin 88 of lever 84 extends through an opening 94 in cavity 80 and into opening 78 of mount sleeve 74.

Figure 9A:
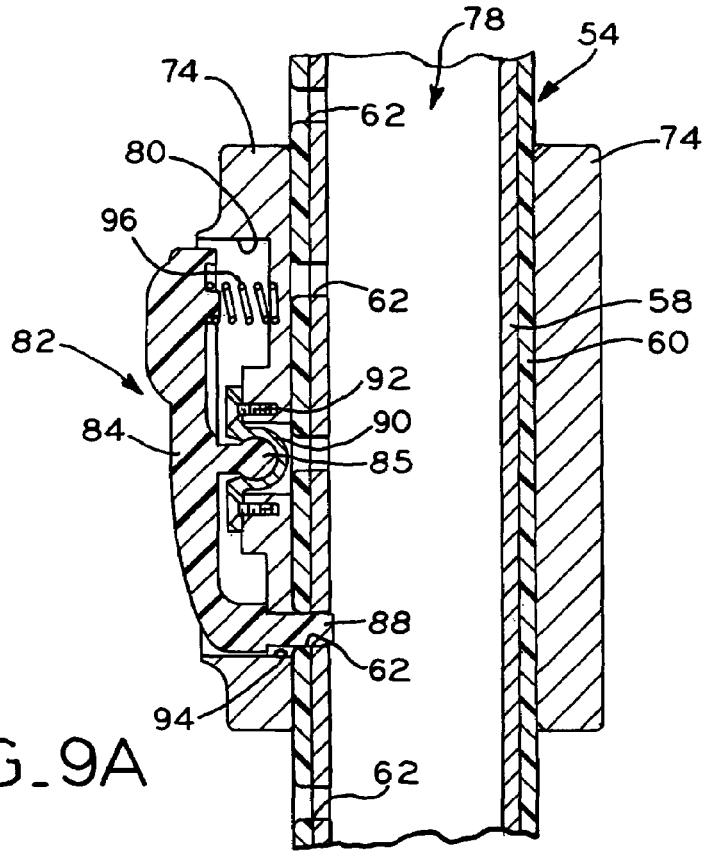
FIG. 9A is a first sectional view taken along line 9A—9A of FIG. 8, showing the lever of the adjustment mechanism in a first position in which movement of the mount sleeve of an armrest or backrest is allowed.

Spring 96 is captured in cavity 80 between spring seat 98 and lever 84, and normally biases lever 84 to a first position, shown in FIG. 9A, in which pin 88 of lever 84 extends a relatively greater extent through holes 94 of mount sleeve and into holes 62 of uprights 54. Depressing button 86 of lever 84 against the bias of spring 96 pivots lever 84 to a second position, shown in FIG. 9B, in which pin 88 of lever 84 is partially retracted from hole 94 in mount sleeve 74, and is completely retracted from hole 62 in upright 54. The foregoing first and second positions of lever 84 of adjustment mechanism 82 allow for vertical adjustment of armrests 18 along uprights 54, as discussed below.

Referring to FIG. 5, armrest 18 may optionally include an adjustment mechanism, such as slide mechanism 100 to which armrest pad 102 is attached by a pair of fasteners 104. Armrest pad 102 may be made of a soft, resilient material, such as a flexible plastic. Slide mechanism 100 is attached with an additional pair of fasteners 106 to armrest support 76 of armrest base 72. Adjustment mechanisms such as slide mechanism 100 are available from many commercial sources, and slide mechanism 100 generally facilitates horizontal sliding movement of armrest pad 102 with respect to armrest support 76 of armrest base 72. Other adjustment mechanisms which may be used with armrests 18 may facilitate pivotal or lateral movement of armrest pad 102, for example. Alternatively, armrest pad 102 may be mounted in a fixed manner to armrest base 72.

With levers 84 of adjustment mechanisms 82 in the second position described above, as shown in FIG. 9B, pins 88 of levers 84 are not received within holes 62 in their associated uprights 54, and armrests 18 are each telescopingly slidable vertically along their respective uprights 54, as shown by the arrows in FIGS. 8 and 9B, with uprights 54 received through passages 78 in mount sleeves 74 of armrests 18. Also, in this position, pins 88 of levers 84 are guidingly received within channel 64 (FIG. 4) of outer plastic layer 60 of uprights 56 to guide the sliding movement of armrests 18 along uprights 56.

Figure 7:
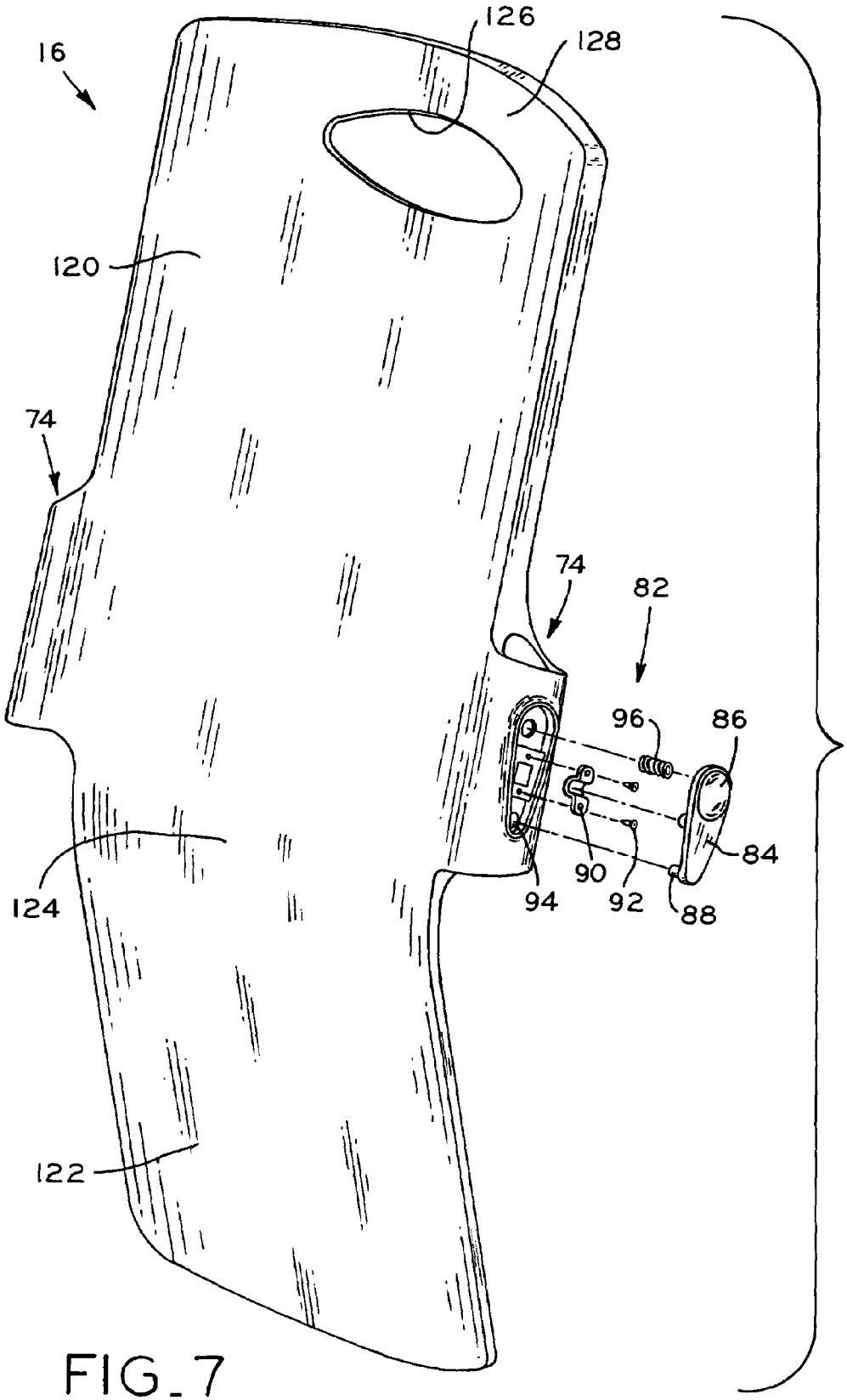
FIG. 7 is a perspective view of the backrest, showing the components of the adjustment mechanism within one of the mount sleeves of the backrest in exploded view.

Referring to FIG. 7, backrest 16 may be formed as a single, integral, shell-like plastic component, such as polypropylene, for example, and generally includes upper portion 120 and lower portion 122 connected by lumbar portion 124. Backrest 16 may be flexible, such that the foregoing portions of backrest 16 may flex slightly relative to one another responsive to movement of a user seated in chair. Upper portion 120 extends at an angle slightly from vertical, which is substantially parallel to the longitudinal axes $L_1$—$L_1$ of uprights 56 discussed above. Lower portion 122 of backrest 16 extends at an angle rearwardly and downwardly from upper portion 120. Lumbar portion 124 of backrest 16 may protrude slightly from the face of upper portion 120 to provide support in the lumbar region of the back of a user seated in chair 10.

Backrest 16 additionally includes a pair of mount sleeves 74 at opposite sides of upper portion 120. Each mount sleeve 74 of backrest 16 is substantially identical to the mount sleeves 74 of armrests 18, and each include an adjustment mechanism 82 identical to those of armrests 18. Therefore, the mount sleeves 74 of backrest 16 will not be described herein in further detail. Backrest 16 includes an opening 126 at the upper end of upper portion 120, which forms a handle 128 which may be grasped by a user to move chair 10 about a floor surface, for example. Backrest 16 is vertically adjustable with respect to uprights 54 in the manner discussed below.

Referring to FIGS. 3, 4 and 8, support brace 130 is fastened to upper ends 132 of uprights 54 with fasteners 134 to secure the positions of upper ends 132 of uprights 54 with respect to one another. Support brace 130 extends behind upper portion 120 of backrest 16 and, may include a logo area 136 (FIG. 8) for the display of a logo, symbol, or a trademark, for example, of the manufacturer of chair 10.

Figure 9B:
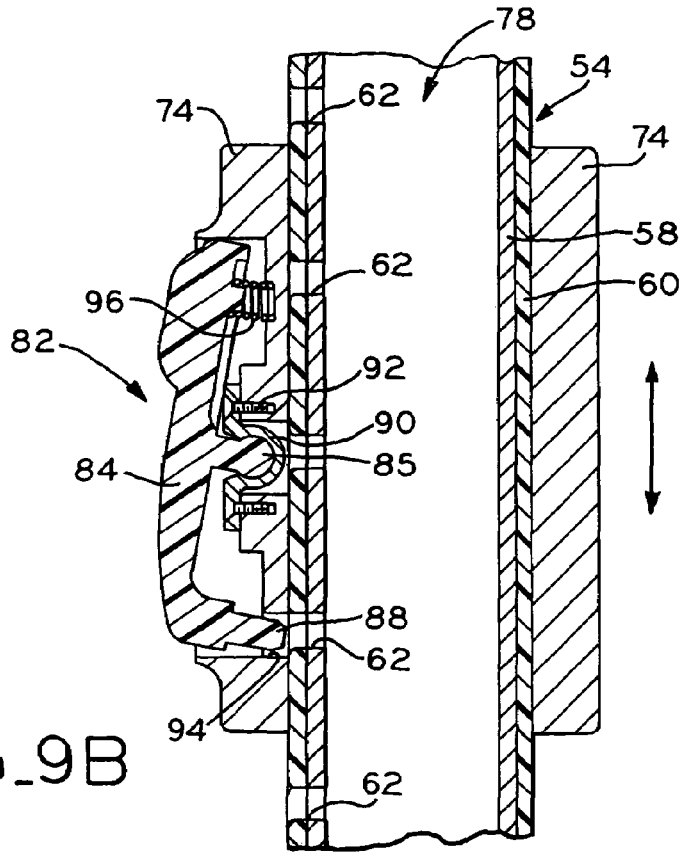
FIG. 9B is a second sectional view taken along line 9B—9B of FIG. 8, showing the lever of the adjustment mechanism in a second position in which movement of the mount sleeve of an armrest or backrest is prevented.

Armrests 18 and backrest 16 are vertically adjustable along uprights 54 as follows. When lever 84 of adjustment mechanism 82 is in its first position shown in FIG. 9A, spring 96 biases lever 84 such that pin 88 extends through hole 94 in mount sleeve 74 and engages within one of the holes 62 in uprights 54, thereby fixing the vertical position of an armrest 18 with respect to its upright 54. Referring to FIG. 9B, when button 86 of lever 84 is depressed by user against the bias of spring 96, lever 84 pivots to retract pin 88 such that pin 88 extends through hole 94 in mount sleeve 74 to a lesser extent, such that pin 88 is retracted from the hole 62 in upright 54 in which it was previously engaged, to thereby allow vertical sliding movement of mount sleeve 74 of armrest 18 along its upright 54. In this position, pins 88 of levers 84 are received within channel 64 (FIG. 4) of outer plastic layer 60 of uprights 56 to guide the sliding movement of armrests 18 along uprights 56.

Following movement of armrest 18 to a desired height with respect to upright 54, release of button 86 of lever 84 allows spring 96 to pivot lever 84 such that pin 88 engages within a selected hole 62 of upright 54 to thereby again fix the position of the armrest 18 with respect to its associated upright 54. Each armrest 18 is independently adjustable with respect to its associated upright 54. Stops 68 (FIG. 8) of uprights 54 limit the downward travel of mount sleeves 74 of armrests 18 on uprights 54, and the mount sleeves 76 of backrest 16 limit the upward travel of mount sleeves 74 of armrests 18 on uprights 54.

In a similar manner, the vertical position of backrest 16 is adjustable by a user. In particular, while standing behind or in front of chair 10, for example, a user simultaneously depresses buttons 86 of each lever 84 of the opposite mount sleeves 74 of backrest 16 to disengage pins 88 from their holes 62 in uprights 54. Thereafter, mount sleeves 74 are freely slidable with respect to uprights 54, with pins 88 of levers 84 guidingly received within channels 64 (FIG. 4) of uprights 54 to guide the sliding movement of backrest 16 along uprights 54. When backrest 16 is located in a desired vertical position, levers 84 are released to allow springs 96 to rotate levers 84 such that pins 88 of levers 84 engage holes 62 in uprights 54 to fix the position of backrest 16. In this manner, the vertical position of backrest 16 is adjustable with respect to uprights 54 by a user to conform to the user's height or posture, for example. Upward travel of mount sleeves 74 of backrest 16 along uprights 54 is limited by support brace 130, and downward travel of mount sleeves 74 of backrest 16 along uprights 54 is limited by mount sleeves 74 of armrests 18.

As shown herein, mount sleeves 74 of armrests 18 are disposed on uprights 54 below mount sleeves 74 of backrest 16, such that armrests 18 are positioned generally below upper portion 120 of backrest 16. However, the foregoing may be reversed, with mount sleeves 74 of armrests 18 positioned on uprights 54 above mount sleeves 74 of backrest 16.

While this invention has been described as having a preferred design, the present invention can be further modified within the spirit and scope of this disclosure. This application is therefore intended to cover any variations, uses, or adaptations of the invention using its general principles. Further, this application is intended to cover such departures from the present disclosure as come within known or customary practice in the art to which this invention pertains and which fall within the limits of the appended claims.

What is claimed is:

1. A chair, comprising:

a base assembly;

a seat supported by said base assembly;

a pair of uprights connected to said base assembly and extending upwardly above said seat, each upright including a longitudinal axis;

an armrest selectively positionable along each upright;

a backrest disposed between said uprights and selectively positionable along said uprights, said armrests and said backrest moveable coaxially along respective longitudinal axes of said uprights; and a brace member connecting upper end portions of said uprights, said brace member extending behind said backrest.

2. The chair of claim 1, wherein each armrest includes a mount sleeve and said backrest includes a pair of mount sleeves, said mount sleeves telescopingly movable along said uprights.

3. The chair of claim 2, wherein said mount sleeves each have a cylindrical profile with an opening therethrough, with respective uprights extending through said openings of said mount sleeves.

4. The chair of claim 2, wherein each upright includes a channel extending therealong, at least a portion of each mount sleeve received within a respective channel for guiding the movement of each mount sleeve along an upright.

5. The chair of claim 2, wherein each upright includes a series of spaced holes therealong, and each mount sleeve includes a retention member selectively engageable within one of said holes.

6. The chair of claim 5, wherein each retention member is mounted to a respective mount sleeve for movement between a first position in which said retention member engages within one of said holes and a second position in which said retention member does not engage within one of said holes, whereby said mount sleeve is fixed with respect to said upright in said first position and is movable with respect to said upright in said second position.

7. The chair of claim 6, wherein each mount sleeve includes a biasing member biasing said retention member to said first position.

8. The chair of claim 1, wherein said uprights extend upwardly from opposite sides of said seat, said uprights disposed proximate a rear portion of said seat.

9. The chair of claim 1, wherein said uprights are each attached to a base member, said base member attached to said base assembly beneath said seat.

10. A chair, comprising:

a base assembly;

a seat supported by said base assembly;

a pair of uprights connected to said base assembly and extending upwardly above said seat;

a pair of armrests each including a mount sleeve selectively slidable along a respective upright; and a backrest disposed between said uprights and including a pair of opposite mount sleeves selectively positionable along said uprights, said mount sleeves of said backrest disposed above said mount sleeves of said anurests, said mount sleeves of said armrests each positionable on said uprights independently of said mount sleeves of said backrest.

11. The chair of claim 10, wherein each upright includes a longitudinal axis, said mount sleeves of said armrests and said backrest moveable coaxially along respective longitudinal axes of said uprights.

12. The chair of claim 10, wherein each mount sleeve has a cylindrical profile with an opening therethrough, said uprights extending respectively through said openings of said mount sleeves.

13. The chair of claim 10, wherein each upright includes a series of spaced holes therealong, and each mount sleeve includes a pin selectively engageable within one of said holes.

14. The chair of claim 13, wherein each pin comprises a portion of a lever mounted with respect to a mount sleeve, said lever movable between a first position in which said pin engages within one of said boles and a second position in which said pin does not engage within one of said holes, whereby said mount sleeve is fixed with respect to said upright in said first position and is movable with respect to said upright in said second position.

15. The chair of claim 14, wherein each mount sleeve further includes a biasing member biasing said lever to said first position.

16. The chair of claim 10, wherein said uprights extend upwardly from opposite sides of said seat, said uprights disposed proximate a rear portion of said seat.

17. A chair, comprising:

a base assembly, comprising:

a base having a plurality of legs with casters;

a height-adjustable pneumatic cylinder extending vertically from said base; and a control housing mounted atop said pneumatic cylinder;

a seat supported by said control housing;

a pair of uprights connected to said control housing beneath said seat, said uprights extending upwardly along opposite sides of said seat;

an armrest mounted to each upright, said armrests each including a mount sleeve, said mount sleeves telescopingly movable along said uprights; and a backrest having opposite sides each including a mount sleeve, said mount sleeves disposed above said armrests and telescopingly movable along said uprights, said mount sleeves of said backrests identical to said mount sleeves of said armrests.

18. The chair of claim 17, wherein said mount sleeves and backrest are adjustably positionable along said uprights.

19. The chair of claim 17, wherein said uprights are disposed proximate a rear portion of said seat.

20. The chair of claim 17, wherein each of said uprights has a tubular profile.

21. The chair of claim 17, wherein said backrest and said mount sleeves are integrally formed as a single plastic component.

22. The chair of claim 17, wherein said backrest includes a lower portion extending rearwardly and downwardly behind said seat.

23. The chair of claim 17, wherein said uprights comprise legs of a substantially U-shaped yoke member, said yoke member having a base portion connected beneath said seat to said control housing.

* * * * *